United States Patent [19]

Mikawa et al.

[11] 3,954,474

[45] May 4, 1974

[54] DEVELOPING METHOD

[75] Inventors: Akikazu Mikawa; Tadao Shishido; Shoji Ishiguro, all of Minami-ashigara, Japan

[73] Assignee: Fuji Photo Film Co., Ltd., Minami-ashigara, Japan

[22] Filed: Aug. 20, 1974

[21] Appl. No.: 499,096

[30] Foreign Application Priority Data

Aug. 20, 1973 Japan ..... 48-93699

[52] U.S. Cl. ..... 96/66.5; 96/66 R; 96/95; 96/109

[51] Int. Cl.[2] ..... G03C 5/30; G03C 1/06; G03C 1/34

[58] Field of Search ..... 96/48 QP, 50 R, 66 R, 96/66.3, 66.4, 66.5, 109, 95

[56] References Cited

UNITED STATES PATENTS

| | | | |
|---|---|---|---|
| 3,565,619 | 2/1971 | Johnson et al. | 96/109 |
| 3,582,322 | 6/1971 | Edens et al. | 96/22 |
| 3,723,125 | 3/1973 | Hayashi et al. | 96/22 |
| 3,730,724 | 5/1973 | Abbott | 96/95 |

*Primary Examiner*—Mary F. Kelley
*Attorney, Agent, or Firm*—Sughrue, Rothwell, Mion, Zinn & Macpeak

[57] ABSTRACT

A method of developing an exposed silver halide photographic material having a silver halide emulsion layer containing a heterocyclic compound having at least one nitrogen atom, having a thione group which does not undergo enolation positioned next to the nitrogen atom, and not having a nitro group in an aldehyde type hardening agent containing developer at a temperature of not less than about 30°C.

8 Claims, No Drawings

DEVELOPING METHOD

BACKGROUND OF THE INVENTION

1. Field of the Invention

The present invention relates to a method of developing a silver halide photographic material, and more particularly to a developing method wherein the formation of fog is prevented.

2. Description of the Prior Art

In processing a silver halide photographic material, for example, an X-ray film, a developer which contains an aldehyde type hardening agent is often used. A difficult problem often encountered using such a developer is the formation of fog in a silver halide emulsion layer. This tendency is remarkable particularly in processing at high temperatures, i.e. above about 30°C. Various compounds have been proposed to prevent the formation of fog in the silver halide emulsion layer. For instance, 1-phenyl-5-mercaptotetrazole is effective in preventing the formation of fog immediately after production and 4-hydroxy-6-methyl1,3,3a,7-tetrazaindene is effective in preventing the formation of fog during storage. These compounds can be used simultaneously with favorable results. Conventionally known antifogging agents and stabilizers, however, are quite ineffective in preventing the formation of fog in the above mentioned developing processing, or when they are used in amounts to the extent that the formation of fog is prevented, the sensitivity is quite reduced. Thus, these conventional materials are not practical.

SUMMARY OF THE INVENTION

Accordingly, an object of the present invention is to provide a method of preventing the formation of fog in high temperature developing processing wherein an aldehyde type hardening agent containing developer is used.

Another object of the present invention is to provide a photographic material having reduced fog when subjected to high temperature developing processing wherein an aldehyde type hardening agent containing developer is used.

A further object of the present invention is to provide a method of producing a photographic image having reduced fog by applying high temperature developing processing wherein an aldehyde type hardening agent is used.

It has been found that these objects can be attained by incorporating a heterocyclic compound having at least one nitrogen atom, having a thione group positioned next to the nitrogen atom which does not undergo enolation, and not having a nitro group in a silver halide emulsion layer of the photographic material.

A method of developing an exposed silver halide photographic material having a silver halide emulsion layer containing a heterocyclic compound having at least one nitrogen atom having a thione group which does not undergo enolation positioned next to the nitrogen atom, and not having a nitro group in an aldehyde type hardening agent containing developer at a temperature of not less than about 30°C, is provided by this invention.

DETAILED DESCRIPTION OF THE INVENTION

In accordance with the present invention, a photographic image wherein the formation of fog is prevented, can be produced by processing an exposed silver halide emulsion layer containing the antifogging agent of the present invention using an aldehyde type hardening agent containing developer at temperatures of not less than about 30°C.

The heterocyclic compounds which can be used in the present invention as an antifogging agent comprise compounds in which a

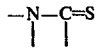

bond is contained as a portion of the ring, the thioketone does not assume a thiol configuration, and no nitro group is present in the molecule.

Those compounds containing the

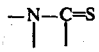

group wherein the thioketone group assumes a thiol configuration by enolation, or wherein the nitro group is present, are not suitable for use in the present invention because they reduce the sensitivity considerably.

Antifogging agents useful for the present invention include those compounds which do not contain a nitro group in the molecule and which are represented by the formula (I)

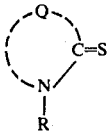

(I)

wherein Q represents the non-metal atoms required for forming a 5- or 6-membered heterocyclic ring together with the —N—C— bond and R represents an alkyl group, an aryl group, or a heterocyclic ring.

The non-metal atoms represented by Q in the formula (I) are usually selected from the group consisting of carbon, nitrogen, oxygen, sulfur, and selenium. Representative examples of heterocyclic rings formed by Q and the —N—C— bond include imidazolidine, oxazolidine, thiazolidine, selenazolidine, thiadiazolidine, selenadiazolidine, imidazoline, oxazoline, thiazoline, selenazoline, thiadiazoline, selenadiazoline, thiohydantoin, dithiohydantoin, rhodamine, dihydropyridine, dihydroquinoline, 4,5-trimethylenethiazoline, 4,5-tetramethylenethiazoline, benzthiazoline, benzoxazoline, benzimidazoline, benzselenazoline, naphthothiazoline, naphthoimidazoline, naphthoxazoline, naphthoselenazoline, etc., rings.

The portion represented by Q can contain monovalent substituents such as alkyl groups, e.g., unsubstituted alkyl groups, e.g., having 1 to about 20 carbon atoms, such as methyl, ethyl, propyl, pentyl, decyl, etc., and substituted alkyl groups, such as having 1 to about 20 carbon atoms in the alkyl moiety, e.g., hydroxyalkyl groups such as hydroxyethyl, etc., haloalkyl groups, such as chloroethyl, etc., aralkyl groups such as benzyl, etc.; alkoxy groups, e.g., methoxy, ethoxy, butoxy, octoxy, etc.; aryl groups, e.g., phenyl, tolyl, methoxyphenyl, chlorophenyl, 3,4-ethylenedioxyphenyl, etc.; alkoxycarbonyl groups, e.g., methoxycarbonyl, ethoxycarbonyl, butoxycarbonyl, octoxycarbonyl, etc.; halogen atoms, e.g., chlorine, bromine, iodine, etc.; oxo groups; benzylidene groups; alkylthio groups, e.g., methylthio, ethylthio, (2-thioxy-3-phenyl-$\Delta^4$-1,3,4-thiadiazoline-5-yl)-thioethylthio, etc.; etc. or divalent substituents required for forming a 5- or 6-membered-saturated or unsaturated carbon ring, which may have the above described substituents, together with two adjacent carbon atoms in the portion represented by Q, e.g., a cyclopentene ring, a cyclohexene ring, a benzene ring, a naphthalene ring, etc.

The alkyl group represented by R can be an unsubstituted alkyl group, e.g., having 1 to about 20 carbon atoms such as methyl, ethyl, propyl, pentyl, decyl, etc., or a hydroxy, aryl, halo, morpholino, etc. substituted alkyl group, e.g., having 1 to about 20 carbon atoms in the alkyl moiety such as hydroxyethyl, chloroethyl, benzyl, morpholino, etc. The aryl group for R can be an unsubstituted aryl group or an alkyl, alkoxy, halo, etc., substituted aryl group such as phenyl, tolyl, methoxyphenyl, chlorophenyl, etc. The heterocyclic rings for R can be, for example, pyridyl, quinonyl etc.

Representative examples of the antifogging agents which can be used in the present invention are given below.

1. 3-Methyl-1,3-benzothiazoline-2-thione
2. 3-Ethyl-1,3-benzothiazoline-2-thione
3. 3-n-Propyl-1,3-benzothiazoline-2-thione
4. 3-iso-Propyl-1,3-benzothiazoline-2-thione
5. 3-Benzyl-1,3-benzothiazoline-2-thione
6. 3,6-Dimethyl-1,3-benzothiazoline-2-thione
7. 3-Methyl-6-methoxy-1,3-benzothiazoline-2-thione
8. 3-n-Hexyl-1,3-benzothiazoline-2-thione
9. 3-propyl-4,5-trimethylene-$\Delta^4$-1,3-thiazoline-2-thione
10. 3-Methyl-4,5-tetramethylene-$\Delta^4$-1,3-thiazoline-2-thione
11. 3-(2-Hydroxyethyl)-4-phenyl-$\Delta^4$-1,3-thiazoline-2-thione
12. 3,4-Dimethyl-$\Delta^4$-1,3-thiazoline-2-thione
13. 3-Phenyl-4-methyl-5-ethoxycarbonyl-$\Delta^4$-1,3-thiazoline-2-thione
14. 3-(2-Pyridyl)-4-methyl-$\Delta^4$-1,3-thiazoline-2-thione
15. 3-(o-Tolyl)-4-methyl-$\Delta^4$-1,3-thiazoline-2-thione
16. 3-(4-Methoxyphenyl)-4-phenyl-$\Delta^4$-1,3-thiazoline-2-thione
17. 3-(4-Chlorophenyl)-4-methyl-$\Delta^4$-1,3-thiazoline-2-thione
18. 3-Methyl-1,3-benzoselenazoline-2-thione
19. 1,3-Dimethyl-benzimidazoline-2-thione
20. 1,3-Di-n-propyl-benzimidazoline-2-thione
21. 1,3-Didecyl-benzimidazoline-2-thione
22. 1,3-Dibenzyl-benzimidazoline-2-thione
23. 1,3-Dibenzyl-5-methyl-benzimidazoline-2-thione
24. 1-Methyl-1,2-dihydroquinoline-2-thione
25. 1-Ethyl-6-methyl-1,2-dihydroquinoline-2-thione
26. 1-Methyl-1,2-dihydropyridine-2-thione
27. 1-Ethyl-1,2-dihydropyridine-2-thione
28. 3-Morpholinomethyl-1,3-thiazoline-2-thione
29. 3-Ethyl-4-oxo-5-(3,4-methylenedioxyphenyl)-1,3-thiazolidine-2-thione
30. 3-Ethyl-4-oxo-5-benzylidene-1,3-thiazolidine-2-thione
31. 3-Methyl-4-oxo-5-benzylidene-1,3-thiazolidine-2-thione
32. 1,3-Dimethyl-imidazolidine-2-thione
33. 3-Methyl-5-methylthio-$\Delta^4$-1,3,4-thiadiazoline-2-thione
34. 3-Phenyl-5-methylthio-$\Delta^4$-1,3,4-thiadiazoline-2-thione 35. 3-Phenyl-5-ethylthio-$\Delta^4$-1,3,4-thiadiazoline-2-thione
36. 3,5-Dimethyl-$\Delta^4$-1,3,4-thiadiazoline-2-thione
37. 3-iso-Propyl-5-benzylidene-4-oxo-1,3-oxazolidine-2-thione
38. 3-Methyl-5-benzylidene-4-oxo-1,3-oxazolidine-2-thione
39. 1,2-bis(2-Thioxo-3-phenyl-$\Delta^4$-1,3,4-thiadiazoline-5-ylthio)ethane The antifogging agents as used in the present invention can be prepared by the methods as described in U.S. Pat. No. 3,723,125, etc.

The antifogging agents as used in the present invention can be dissolved in water or organic solvents miscible with water, such as methanol and added to the silver halide emulsion during chemical ripening or after chemical ripening. The amount of the antifogging agent generally ranges from about $1 \times 10^{-5}$ to $1 \times 10^{-2}$ mole per mole of silver halide and preferably ranges from about $1 \times 10^{-4}$ to $1 \times 10^{-3}$.

For the halide emulsion layer as processed in accordance with the present invent, various silver halides can be used. For instance, silver chloride, silver bromide, silver chlorobromide, silver iodobromide, silver chloroiodobromide, etc. can be used. Particularly, silver iodobromide and silver chloroiodobromide are useful, and those silver halides wherein the iodide content is about 1 to 8 mole % and the chloride content is not more than about 20 mole % are preferred. The crystal structure and grain size of the silver halide particle are not limited. The structure of the silver halide grains can be either uniform or of a layer structure wherein the outside and the inside of the grains are different. Moreover, both those silver halides wherein a latent image is mainly formed on the surface of the grains, and those silver halides wherein a latent image is mainly formed inside of the grains can be used.

The silver halide emulsion can be produced by conventional methods. For instance, a single jet process, a double jet process, a controlled double jet process, etc. can be used. Moreover, the halogen conversion process as described in British Pat. No. 635,841, U.S. Pat. No. 3,622,318, etc. can be used.

As the binder for the silver halide emulsion, all hydrophillic colloids which are used in conventional photographic emulsions can be used. Useful binders include gelatin, gelatin derivatives, colloidal albumin, casein, cellulose derivatives such as carboxymethylcellulose and hydroxyethyl cellulose, agar, sodium alginate, polyvinyl alcohol, poly-N-vinyl pyrrolidone, acrylic acid based polymers, acrylamide based polymers, etc. They can be used alone or, if desired, as a mixture comprising two or more thereof. The gelatin derivatives include those compounds wherein the functional groups contained in the gelatin, i.e. an amino group, an imino group, a hydroxy group, and a carboxyl group are treated with a reagent having a group capable of reacting with the functional groups, or wherein other polymeric molecular chains are grafted. These reagents include the isocyanates, acid chlorides, and acid anhydrides as described in U.S. Pat. No. 2,614,928; the acid anhydrides as described in U.S. Pat. No. 3,118,766; bromoacetic acid as described in Japanese Pat. Publication No. 5514/1964; the phenyl glycidyl ethers as described in Japanese Pat. Publication No. 2684/1967; the vinylsulfone compounds as described in U.S. Pat. No. 3,132,945; the N-allylvinylsulfonamides as described in British Pat. No. 861,414;

the maleinimide compounds as described in U.S. Pat. No. 3,186,846; acrylonitrile as described in U.S. Pat. No. 2,594,293; the polyalkyleneoxides as described in U.S. Pat. No. 3,312,553; the epoxy compounds as described in Japanese Pat. Publication No. 26845/1967; the acid esters as described in U.S. Pat. No. 2,763,639; the alkanesultones as described in British Pat. No. 1,033,189; etc.

Graft polymers to be grafted to the gelatin are described in U.S. Pat. Nos. 2,763,625, 2,831,767, and 2,956,884, Polymer Letters, Vol. 5, page 595 (1967), Phot. Sci. Eng., Vol. 9 page 148 (1965), J. Polymer Sci., A-I, Vol. 9, page 3199 (1971), etc. Polymers or copolymers of vinyl monomers such as acrylic acid, methacrylic acid, or the ester, amide, nitrile derivatives thereof, or styrene can be used. Among them, hydrophilic vinyl polymers which are miscible with the gelatin to some extent, such as the homo- or copolymers of acrylic acid, methacrylamide, hydroxyalkylacrylates, hydroxyalkylmethacrylates, etc. are useful.

Conventional chemical sensitization such as gold sensitization as described in U.S. Pat. Nos. 2,540,085, 2,597,856, 2,597,915, 2,399,083, etc., sensitization with the ions of the metals of Group VIII of the Periodic Table, sulfur sensitization as described in U.S. Pat. Nos. 1,574,944, 2,278,947, 2,440,206, 2,410,689, 3,189,458, 3,415,649, etc., reduction sensitization as described in U.S. Pat. Nos. 2,518,689, 2,419,974, 2,983,610, etc. and like methods, alone or in combination, can be applied to the silver halide emulsion as used in the present invention. Representative examples of chemicalsensitizers include potassium chloroaurate, aurous thiosulfate, potassium chloropalladate, allylthiocarbamide, thiourea, sodium thiosulfate, cystine, stannous chloride, phenylhydrazine, etc.

The sensitivity of the silver halide emulsion can be increased by the use of polyoxyethylene derivatives, polyoxypropylene derivatives, quaternary ammonium group containing compounds, etc.

The silver halide emulsion can be spectrally sensitized by the use of sensitizing dyes such as the cyanines, merocyanines, hemicyanines, and the like. Useful sensitizing dyes are described, for example, in U.S. Pat. Nos. 2,503,776, 2,526,632, etc.

The silver halide emulsion can contain other antifogging agents or stabilizers as well as the antifogging agents of the present invention. For example, the azoles, azaindenes, mercaptans, and chlorides of cadmium, lead, mercury, gold and other noble metals, etc. are useful.

The silver halide emulsion can contain conventional hardening agents. Representative examples include formaldehyde, and the aldehyde compounds as described in U.S. Pat. No. 3,232,764; ketone compounds such as diacetyl and cyclopentadione; 2-hydroxy-4,6-dichloro-1,3,5-triazine and reactive halogen containing compounds as described in U.S. Pat. Nos. 3,288,775, 2,732,303, British Pat. Nos. 974,723, 1,167,207, etc.; divinylsulfone, 5-acetyl-1,3-diacryloylhexahydro-1,3,5-triazine, and reactive olefin containing compounds as described in U.S. Pat. Nos. 2,635,718, 3,232,763, British Pat. No. 994,869, etc.; N—hydroxymethylphthalimide and N-methylol compounds as described in U.S. Pat. Nos. 2,732,316, 2,586,168, etc.; isocyanates as described in U.S. Pat. No. 3,103,437, etc.; aziridine compounds as described in U.S. Pat. Nos. 3,017,280, 2,983,611, etc.; acid derivatives as described in U.S. Pat. Nos. 2,725,294, 2,725,295, etc.; carbodiimide based compounds as described in U.S. Pat. No. 3,100,704, etc.; epoxy compounds as described in U.S. Pat. No. 3,091,537, etc.; isooxazole based compounds as described in U.S. Pat. Nos. 3,321,313, 3,543,292, etc.; halocarboxyaldehydes such as mucochloric acid; dioxane derivatives such as dihydroxydioxane, dichlorodioxane, and the like; and inorganic hardening agents such as chromium alum, zirconium sulfate and the like. In place of these compounds, precursors such as the alkali metal bisulfite aldehyde adducts, methylol derivatives of hydantoin, primary aliphatic nitroalcohols and the like, can be used.

The silver halide emulsion can contain conventionally used photographic additives such as gelatin plasticizers, e.g., glycerin; matting agents, e.g., a vinyl latex, silicon dioxide, etc.; surface active agents such as saponin, sodium alkylbenzene sulfonate, perfluorohydrocarbon, and the like; ultraviolet absorbers, etc.

As the support for use in the photographic material of the present invention, all of the conventionally used photographic supports can be employed. For example, cellulose films such as cellulose nitrate, cellulose acetate, cellulose acetate butyrate, and the the like, polyester films such as polyethylene terephthalate, polystyrene film, polycarbonate film, paper, paper coated with synthetic polymers, metal, glass, etc. can be used. The support can contain, if desired, coloring agents such as carbon black, titanium oxide, azo or anthraquinone dyes, etc. A suitable coating amount of the silver halide ranges from about 10 mg to 100 mg, preferably 20 mg to 70 mg, (as silver) per 100 $cm^2$ of the support.

The photographic materials as processed in accordance with the present invention can be applied to various kinds of photographic systems, such as non-spectrally sensitive, ortho sensitive, panchromatically sensitive, infrared sensitive systems as well as X-ray photographic materials. Furthermore, the photographic material can be used in the field of color photography such as a color photography material of the type containing a color forming coupler, a color photographic material of the type where the material is developed with a developer containing a color forming coupler, a color photographic material for the silver dye bleaching method, etc.

A photographic material having a silver halide emulsion layer containing the antifogging agent of the present invention is, after exposure, developed using a developer containing an aldehyde hardening agent at high temperatures of not less than 30°C.

The aldehyde hardening agents which can be used in the present invention are well known in the field of photography and are used in a photographic processing liquid, particularly a developer, to harden the gelatin or other hydrophilic colloids. Suitable aldehyde hardening agents include, for example, aliphatic aldehydes such as formaldehydes, glyoxal, succinaldehyde, glutaraldehyde, pyruvicaldehyde, etc., as described in U.S. Pat. No. 3,232,761 and an aromatic aldehydes such as phthalaldehyde, 2-hydroxy-5-methylisophthalaldehyde, 2,5-dicarboxyterephthalaldehyde, etc., as described in U.S. Pat. Nos. 3,565,632 and 3,677,760, and dialdehyde hardening agents. When compounds of this type are used in the developer, it is possible to effect prompt development before the permeability of the developer is limited by the hardening action. Preferred hardening agents are aliphatic dialdehydes or their alkali metal bisulfites. Particularly, those compounds which have the aldehyde group bonded through a straight carbon chain containing 2 to 3 carbon atoms are useful. Representative compounds are maleic dialdehyde, glutaraldehyde, and the sodium bisulfites thereof. U.S. Pat. No. 3,232,761 describes hardening agents and bisulfites thereof which are useful in the present invention. A suitable amount of the aldehyde hardening agent ranges from about 0.01 to 0.5, preferably 0.03 to 0.2, mol/liter of the developer.

The developers which can be used in the present invention contain the aldehyde hardening agent, and other conventionally used developer ingredients. The developer contains developing agents for silver halide. Suitable examples of developing agents which can be used in the present invention, include dihydroxybenzenes such as hydroquinone, chlorohydroquinone, bromohydroquinone, isopropylhydroquinone, toluhydroquinone, methylhydroquinone, 2,3-dichlorohydroquinone, 2,5-dimethylhydroquinone and the like; 3-pyrazolidones such as 1-phenyl-3-pyrazolidohe, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone and the like; aminophenols such as o-aminophenol, p-aminophenol, N-methyl-o-aminophenol, N-methyl-p-aminophenol,2,4-diaminophenol and the like; pyrogallol; ascorbic acid, 1-aryl-3-aminopyrazolines such as 1-(p-hydroxyphenyl)-3-aminopyrazoline, 1-(p-methylaminophenyl)-3-pyrazoline, 1-(p-aminophenyl)-3-aminopyrazoline, 1-(p-amino-m-methylphenyl)-3-aminopyrazoline and the like; etc. and mixtures thereof, which are all well known in the art. The developer can contain, if desired, various developer additives such as alkali agents, e.g., sodium carbonate, potassium carbonate, sodium metaborate, sodium hydroxide, potassium hydroxide, lower alkanolamines, and the like; preservatives, e.g., sodium sulfite, potassium sulfite, sodium bisulfite, potassium pyrosulfate, alkanol amine sulfites, and the like; chelating agents, e.g., ethylenediamine tetraacetate, nitrilotriacetic acid, polyphosphoric acid salts, and the like; antifogging agents, e.g., 5-nitrobenzimidazole, 5-nitrobenzindazole, 6-nitroisoindazole, 5-methylbenzotriazole, 5-nitrobenzotriazole, 1-phenyl-5-mercaptotetrazole, and the like, etc.

The pH of the developer is not less than about 7 and suitably ranges from 8 to 12, or higher. Particularly, a pH of about 9 to 11 is preferred.

The temperature of the developer is not less than about 30°C, and a range of about 30° to 65°C, or higher is useful. Particularly, the range of 35° to 55°C is preferred.

The developing period will vary depending upon the processing temperature, the composition of the developer, and so on, and is not limited. In general, the time will range from about 5 seconds or less to about 5 minutes, or longer. Particularly, a developing period of within one minute is preferred for rapid processing.

The processing can be carried out using conventional methods. Either a batch system or a continuous system can be employed. Particularly preferred is a method in which the photosensitive material is continuously processed by passing the material through processing vessels containing each of the processing solutions by roller conveyor. This method is described in U.S. Pat. No. 3,025,779.

The present invention is further illustrated by reference to the following examples. Unless otherwise indicated, all parts, percents, ratios and the like are by weight.

EXAMPLE 1

To 1 kg of a gelatin-silver iodide bromide emulsion which contained 1.5 mole % of silver iodide and was sensitized by the use of sodium thiosulfate and potassiumgold chloride, 10 ml of a 1% aqueous solution of 4-hydroxy-6-methyl-1,3,3a,7-tetrazaindene, 30 ml of a 10% aqueous solution of saponin and 20 ml of a 1% aqueous solution of mucochloric acid were added. Furthermore, the various antifogging agents as shown in Table 1 were added and the resulting emulsions were coated on a polyethylene terephthalate film support in an amount of 50 mg/100 cm² to prepare samples. These samples were stepwise exposed and subjected to the following two kinds of developing processings.

Development I: At 20°C for 4 minutes using Developer I

Development II: At 40°C for 30 seconds using Developer II

| | | |
|---|---|---|
| Developer I | | |
| 1-Phenyl-3-pyrazolidone | 0.5 | g |
| Sodium Sulfite (anhydrous) | 70 | g. |
| Hydroquinone | 9 | g |
| Sodium Carbonate (monohydrate) | 35 | g |
| Potassium Bromide | 5 | g |
| Water to make | 1 | liter |
| Developer II | 40 | g |
| Hydroquinone | 25 | g |
| Boric Acid | 10 | g |
| 1-Phenyl-3-pyrazolidone | 1.5 | g |
| Potassium Hydroxide | 30 | g |
| 5-Methylbenzotriazole | 0.15 | g |
| Glutaraldehyde Bisulfite | 15 | g |
| Acetic Acid | 12 | g |
| Potassium Bromide | 10 | g |
| Water to make | 1 | liter |

After the developing processing, the sample were processed with a fixing solution containing sodium thiosulfate and acetic acid, and then washed and dried. The results thus obtained are shown in Table 1.

Table 1

| Anti-fogging Agent | Amount (mole/mole AgX) | Developer: Developer I Fog | Developer I Specific Sensitivity | Developer II Fog | Developer II Specific Sensitivity |
|---|---|---|---|---|---|
| None (control) | — | 0.04 | 100 | 0.30 | 100 |
| Compound (22)* | $1 \times 10^{-4}$ | 0.04 | 96 | 0.08 | 76 |
| Compound (1)* | $1 \times 10^{-5}$ | 0.04 | 100 | 0.12 | 87 |
| 1-Phenyl-5-mercapto- | $1.5 \times 10^{-4}$ | 0.02 | 54 | 0.12 | 50 |

Table 1-continued

| Anti-fogging Agent | Amount (mole/mole AgX) | Developer I Fog | Developer I Specific Sensitivity | Developer II Fog | Developer II Specific Sensitivity |
|---|---|---|---|---|---|
| tetrazole | | | | | |

*of the invention

It can be seen from the results in Table 1 that on processing at a high temperature using an aldehyde compound containing developer, no remarkable formation of fog is observed with Developer I. In addition on using a conventional antifogging agent, 1-phenyl-5-mercaptotetrazole, to prevent the formation of fog, the sensitivity is quite reduced. Further, the compounds of the present invention can prevent the formation of fog without reducing the sensitivity. Thus, it can be seen that the photographic material containing the antifogging agent of the present invention can provide an image, in which the formation of fog is prevented and in which the sensitivity is not reduced when developed at a temperature of not less than 30°C using an aldehyde hardening agent containing developer.

EXAMPLE 2

To the same emulsion as used in Example 1, Compounds (8) and (20) were added in an amount of $1 \times 10^{-4}$ mole per mole of the silver halide. The thus prepared emulsions were coated on a polyethylene terephthalate film support in a silver coating amount of 50 mg/cm² to prepare samples. These samples were stepwise exposed and developed for 30 seconds with Developer II as used in Example 1 at various developing temperatures. The results thus obtained are shown in Table 2.

Table 2

| Antifoggine Agent | Development Temperature 25°C Fog | 25°C Specific Sensitivity | 30°C Fog | 30°C Specific Sensitivity | 35°C Fog | 35°C Specific Sensitivity | 40°C Fog | 40°C Specific Sensitivity | 45°C Fog | 45°C Specific Sensitivity |
|---|---|---|---|---|---|---|---|---|---|---|
| Compound (8) | 0.05 | 60 | 0.05 | 66 | 0.05 | 90 | 0.07 | 139 | 0.30 | 194 |
| Compound (20) | 0.05 | 60 | 0.05 | 66 | 0.06 | 94 | 0.11 | 164 | 0.42 | 208 |
| None (control) | 0.04 | 60 | 0.06 | 70 | 0.10 | 100 | 0.29 | 208 | 0.69 | 410 |

It can be seen from the above results that the antifogging agents of the present invention are useful as an antifogging agent for a silver halide emulsion layer which is developed with an aldehyde hardening agent containing developer at temperatures of not less than 30°C.

EXAMPLE 3

To 1 kg of a gelatin-silver iodide bromide emulsion which contained 5 mol% of silver iodide and was sensitized with sodium thiosulfate and potassium gold chloride, 10 ml of a 1% aqueous solution of 4-hydroxy-6-methyl-1,3,3a,7-tetrazaindene, 30 ml of a 10% aqueous solution of saponin, and 20 ml of a 1% aqueous solution of mucochloric acid were added. To the resulting emulsion were added the various antifogging agents as indicated in Table 3. The thus prepared emulsions were coated on a polyethylene terephthalate film support in a silver coating amount of 60 mg/100 cm² to prepare samples. These samples were stepwise exposed and processed in accordance with Development II as set forth in Example 1. The results obtained are shown in Table 3.

Table 3

| Antifogging Agent | Amount (mole/mole AgX) | Fog | Specific Sensitivity |
|---|---|---|---|
| None | — | 0.34 | 120 |
| Compound (21) | $1 \times 10^{-4}$ | 0.12 | 94 |
| Compound (11) | $3 \times 10^{-4}$ | 0.10 | 88 |
| 1-Phenyl-5-mercapto-tetrazole | $1.5 \times 10^{-4}$ | 0.14 | 53 |

The excellent properties of the antifogging agents of the present invention can be seen from the above data.

EXAMPLE 4

To a 1 kg of a gelatin-silver chloroiodobromide emulsion which contained 1.5 mole % of silver iodide and 0.5 mole % of silver chloride, and was sensitized with sodium thiosulfate and potassium gold chloride, 10 ml of a 1% aqueous solution of 4-hydroxy-6-methyl-1,3,3a,7-tetrazaindene, 30 ml of a 10% aqueous solution of saponin, and 20 ml of a 1% aqueous solution of mucochloric acid were added. To the resulting emulsion were added the various antifogging agents as indicated in Table 4. The thus prepared emulsions were coated on a polyethylene terephthalate film support in a silver coating amount of 50 mg/cm² to prepare samples. These samples were exposed and processed in accordance with Development II as set forth in Example 1. The results obtained are shown in Table 4.

Table 4

| Antifogging Agent | Amount (mole/mole AgX) | Fog | Specific Sensitivity |
|---|---|---|---|
| None | — | 0.36 | 100 |
| Compound (38)* | $0.3 \times 10^{-4}$ | 0.25 | 92 |
| | $1.2 \times 10^{-4}$ | 0.18 | 75 |
| Compound (37)* | $0.3 \times 10^{-4}$ | 0.28 | 94 |
| | $1.2 \times 10^{-4}$ | 0.21 | 83 |
| | $2.4 \times 10^{-4}$ | 0.17 | 79 |
| Compound (30)* | $0.4 \times 10^{-4}$ | 0.25 | 94 |
| | $1.6 \times 10^{-4}$ | 0.21 | 89 |
| | $6.4 \times 10^{-4}$ | 0.17 | 85 |

*of the Invention

The excellent properties of the antifogging agents of the present invention can be seen from the above data.

While the invention has been described in detail and with reference to specific embodiments thereof, it will be apparent to one skilled in the art that various changes and modifications can be made therein without departing from the spirit and scope thereof.

What is claimed is:

1. The process for developing an imagewise exposed silver halide photosensitive material using a developer containing an aldehyde hardening agent at temperatures of not less than about 30°C, wherein a silver halide emulsion layer of the photosensitive material contains at least one heterocyclic compound having at least one nitrogen atom, having a thione group which does not undergo enolation positioned next to the nitrogen atom, and not having a nitro group as an antifogging agent wherein the heterocyclic compound is represented by the followng general formula:

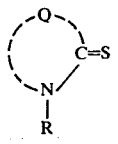

wherein Q represents the non-metal atoms required for forming a 5- or 6-membered heterocyclic ring together with the-N-C-moiety and R represents an alkyl group, an aryl group, or a heterocyclic ring.

2. The process according to claim 1, wherein the nonmetal atoms are selected from the group consisting of carbon, nitrogen, oxygen, sulfur and selenium.

3. The process according to claim 1, wherein the 5- or 6-membered heterocyclic ring is an imidazolidine, oxazolidine, thiazolidine, selenazolidine, thiadiazolidine, selenadiazolidine, imidazoline, oxazoline, thiazoline, selenazoline, thiadiazoline, slenadiazoline, thiohydantoin, dithiohydantoin, rhodanine, dihydropyridine, dihydroquinoline, 4,5-trimethylenethiazoline, 4,5-tetramethylenethiazoline, benzthiazoline, benzoxazoline, benzimidazoline, benzselenazoline, naphthothiazoline, naphthoimidazoline, naphthoxazoline, or Naphthoselenazoline ring.

4. The process according to claim 1, wherein Q has at least one monovalent substituent selected from the group consisting of an alkyl group, an alkoxy group, an aryl group, an alkoxycarbonyl group, a halogen atom, an oxo group, a benzylidene group, and an alkylthio group.

5. THe process according to claim 1 wherein Q has divalent substituents required for forming a 5- or 6-membered saturated or unsaturated carbon ring together with two adjacent carbon atoms in Q.

6. The process according to claim 1, wherein the heterocyclic compound is present in the silver halide emulsion in an amount of about $1 \times 10^{-5}$ to $1 \times 10^{-2}$ mole per mole of the silver halide.

7. The process according to claim 1, wherein the developing temperature ranges from about 30° to 65°C.

8. The process according to claim 1, wherein the pH of the developer ranges from about 8 to 12.

* * * * *